US011199071B2

(12) United States Patent
Helms et al.

(10) Patent No.: US 11,199,071 B2
(45) Date of Patent: Dec. 14, 2021

(54) FULL BORE BUOYANCY ASSISTED CASING SYSTEM

(71) Applicant: Halliburton Energy Services, Inc., Houston, TX (US)

(72) Inventors: Lonnie Carl Helms, Humble, TX (US); Kevin Wendell Ardoin, Spring, TX (US); Stephen Allen Yeldell, Humble, TX (US); Julio Alberto Cornejo, Sugar Land, TX (US); Frank Vinicio Acosta, Spring, TX (US); Saul Emmanuel Vazquez Niebla, Humble, TX (US); Rafael Hernandez, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 82 days.

(21) Appl. No.: 16/648,983

(22) PCT Filed: Nov. 20, 2017

(86) PCT No.: PCT/US2017/062528
§ 371 (c)(1),
(2) Date: Mar. 19, 2020

(87) PCT Pub. No.: WO2019/099046
PCT Pub. Date: May 23, 2019

(65) Prior Publication Data

US 2020/0284121 A1 Sep. 10, 2020

(51) Int. Cl.

| | |
|---|---|
| ***E21B 34/06*** | (2006.01) |
| ***E21B 17/00*** | (2006.01) |
| ***E21B 33/12*** | (2006.01) |

(52) U.S. Cl.
CPC ..... *E21B 34/063* (2013.01); *E21B 17/00* (2013.01); *E21B 33/12* (2013.01)

(58) Field of Classification Search
CPC ..... E21B 17/00; E21B 34/063; E21B 33/12
See application file for complete search history.

(56) References Cited

U.S. PATENT DOCUMENTS

| | | | |
|---|---|---|---|
| 3,463,351 | A | 8/1969 | Mills |
| 3,779,263 | A | 12/1973 | Edwards et al. |
| 3,980,134 | A | 9/1976 | Amancharla |

(Continued)

FOREIGN PATENT DOCUMENTS

| | | | |
|---|---|---|---|
| EP | 0566290 | A1 | 10/1993 |
| EP | 0681087 | B1 | 9/2000 |

(Continued)

OTHER PUBLICATIONS

International Search Report and Written Opinion dated Oct. 27, 2020, issued in PCT Application No. PCT/US2020/039399.

(Continued)

*Primary Examiner* — Steven A MacDonald
(74) *Attorney, Agent, or Firm* — McAfee & Taft

(57) ABSTRACT

A buoyancy assist tool has an outer case with a rupture disk assembly connected therein. The buoyancy assist tool defines the upper end of a buoyancy chamber in a well casing. A sleeve in the outer case traps the rupture disk membrane after it has ruptured to provide full bore flow through the casing.

18 Claims, 6 Drawing Sheets

(56) References Cited

U.S. PATENT DOCUMENTS

| | | | | |
|---|---|---|---|---|
| 4,457,376 | A * | 7/1984 | Carmody | E21B 34/10 166/332.8 |
| 5,150,756 | A | 9/1992 | Hassanzadeh | |
| 5,479,986 | A | 1/1996 | Gano et al. | |
| 5,526,846 | A * | 6/1996 | Maloberti | E21B 17/017 138/109 |
| 5,765,641 | A | 6/1998 | Shy et al. | |
| 5,826,661 | A | 10/1998 | Parker et al. | |
| 6,026,903 | A | 2/2000 | Shy et al. | |
| 6,076,600 | A | 6/2000 | Vick, Jr. et al. | |
| 6,161,622 | A | 12/2000 | Robb et al. | |
| 6,324,904 | B1 | 12/2001 | Ishikawa et al. | |
| 6,450,263 | B1 | 9/2002 | Schwendemann | |
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 * | 1/2004 | Hinrichs | E21B 47/117 166/317 |
| 6,758,281 | B2 | 7/2004 | Sullaway et al. | |
| 7,270,191 | B2 | 9/2007 | Drummond et al. | |
| 8,505,621 | B2 | 8/2013 | Telfer et al. | |
| 9,033,055 | B2 | 5/2015 | Mccoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 * | 12/2016 | Noske | E21B 21/103 |
| 9,540,904 | B2 | 1/2017 | Petrowsky | |
| 9,593,542 | B2 | 3/2017 | Getzlaf et al. | |
| 10,138,707 | B2 | 11/2018 | Tolman et al. | |
| 10,323,478 | B2 * | 6/2019 | Berscheidt | E21B 33/1293 |
| 10,989,013 | B1 * | 4/2021 | Helms | E21B 33/126 |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0073075 | A1 | 3/2008 | Buyers et al. | |
| 2008/0115942 | A1 | 5/2008 | Keller et al. | |
| 2010/0270031 | A1 | 10/2010 | Patel | |
| 2010/0294376 | A1 * | 11/2010 | O'Brien | F16K 1/2007 137/12 |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1 | 6/2014 | Fripp et al. | |
| 2014/0216756 | A1 * | 8/2014 | Getzlaf | E21B 33/146 166/376 |
| 2014/0224505 | A1 | 8/2014 | Ramon | |
| 2014/0338923 | A1 | 11/2014 | Fripp et al. | |
| 2015/0107843 | A1 | 4/2015 | Talley et al. | |
| 2015/0129205 | A1 | 5/2015 | Hofman et al. | |
| 2015/0240596 | A1 * | 8/2015 | Horwell | E21B 34/16 166/332.8 |
| 2015/0252650 | A1 * | 9/2015 | Gaspard | E21B 34/06 166/285 |
| 2016/0177668 | A1 * | 6/2016 | Watson | E21B 21/10 166/373 |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 * | 3/2018 | Dedman | E21B 43/10 |
| 2018/0209245 | A1 * | 7/2018 | Shimmoto | E21B 34/12 |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |
| 2020/0284121 | A1 * | 9/2020 | Helms | E21B 17/00 |
| 2021/0062598 | A1 * | 3/2021 | Yuan | E21B 23/065 |
| 2021/0123317 | A1 * | 4/2021 | Yuan | E21B 31/00 |
| 2021/0131222 | A1 * | 5/2021 | Helms | E21B 33/1208 |

FOREIGN PATENT DOCUMENTS

| | | | | |
|---|---|---|---|---|
| EP | 1009907 | B1 * | 2/2006 | E21B 47/117 |
| GB | 2483869 | A * | 3/2012 | E21B 21/10 |
| JP | 6551001 | B2 | 7/2019 | |
| WO | 2014098903 | A1 | 6/2014 | |
| WO | 2015073001 | A1 | 5/2015 | |
| WO | 2016176643 | A1 | 11/2016 | |
| WO | 2019099046 | A1 | 5/2019 | |

OTHER PUBLICATIONS

International Search Report and Written Opinion dated Feb. 24, 2021, issued in PCT Application No. PCT/US2020/040157.

International Search Report and Written Opinion dated Aug. 14, 2018, issued in corresponding PCT Application No. PCT/US2017/062528.

International Search Report and Written Opinion dated Jul. 21, 2020, issued in PCT Application No. PCT/US2019/059864.

International Search Report and Written Opinion dated Jul. 23, 2020, issued in PCT Application No. PCT/US2019/061714.

International Search Report and Written Opinion dated Aug. 11, 2020, issued in PCT Application No. PCT/US2019/065862.

International Search Report and Written Opinion dated Aug. 31, 2020, issued in PCT Application No. PCT/US2020/012307.

International Search Report and Written Opinion dated Sep. 19, 2019, issued in PCT Application No. PCT/US2018/066889.

International Search Report and Written Opinion dated Sep. 19, 2019, issued in PCT Application No. PCT/US2018/067161.

International Search Report and Written Opinion dated Aug. 23, 2019, issued in PCT Application No. PCT/US2018/064085.

International Search Report and Written Opinion dated Aug. 14, 2019, issued in PCT Application No. PCT/US2018/064051.

International Search Report and Written Opinion dated Jan. 14, 2020, issued in PCT Application No. PCT/US2019/027502.

International Search Report and Written Opinion dated Feb. 5, 2020, issued in PCT Application No. PCT/US2019/031541.

International Search Report and Written Opinion dated Jan. 16, 2020, issued in PCT Application No. PCT/US2019/027625.

International Search Report and Written Opinion dated Jan. 21, 2020, issued in PCT Application No. PCT/US2019/028508.

International Search Report and Written Opinion dated May 25, 2020, issued in PCT Application No. PCT/US2019/056206.

International Search Report and Written Opinion dated May 26, 2020, issued in PCT Application No. PCT/US2019/059757.

* cited by examiner

FULL BORE BUOYANCY ASSISTED CASING SYSTEM

BACKGROUND

The length of deviated or horizontal sections in well bores is such that it is difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

BRIEF DESCRIPTION OF THE DRAWINGS

FIG. 6 is the embodiment of FIG. 4 in the second position.

SUMMARY

Figure 1:
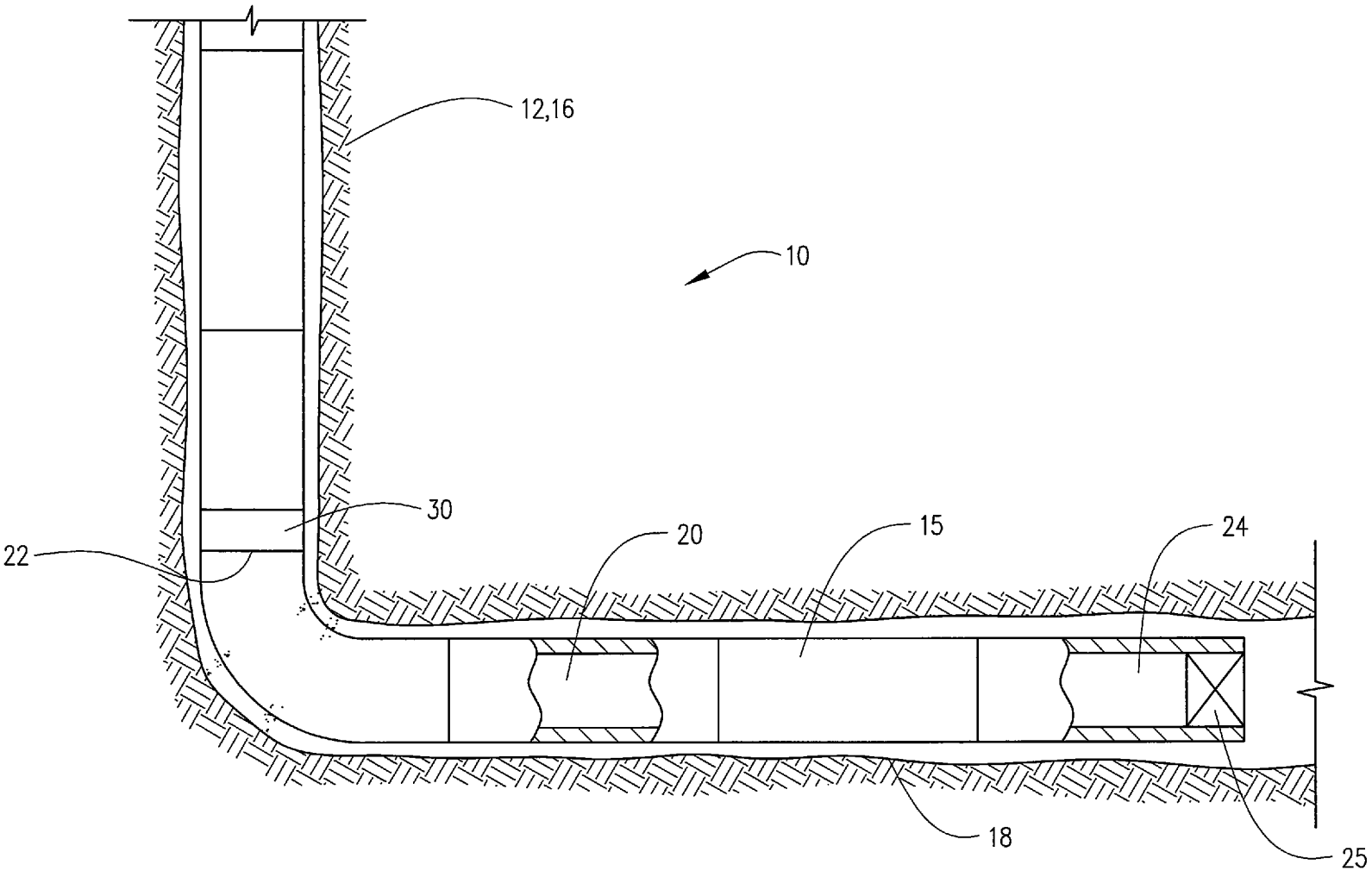
FIG. 1 is a schematic cross section view of an exemplary well bore with a well casing therein.

The current disclosure is directed to a well casing with a buoyancy chamber. The well casing comprises a plurality of casing joints with a float device connected in the well casing. The float device defines a lower end of the buoyancy chamber. A pressure barrier, which may be a rupture disk in the well casing, defines an upper end of the buoyancy chamber. A sliding sleeve is disposed in the well casing and is movable from first to second positions in the well casing. In the second position the sleeve will trap a burst rupture disk membrane against an inner surface of the well casing. The sleeve may comprise a sliding sleeve which is a collet sleeve movable from the first to the second positions. In one embodiment the rupture disk is ruptured when a pressure in the casing above the rupture disk reaches a predetermined rupture pressure. Likewise, in an embodiment the sliding sleeve moves from first to second positions upon the application of a predetermined hydraulic pressure in the well casing which will move the sleeve. The sleeve may define an upper end for receiving a plug or ball delivered into the well casing. The upper end may define a plug seat. In one embodiment the hydraulic pressure will move the sleeve from the first to the second positions after the plug engages the seat. The plug will be released from the sleeve upon the sleeve reaching the second position in the well thereby leaving an unobstructed bore for the passage of well equipment therethrough.

In another embodiment a buoyancy assist tool comprises an outer case defining a groove therein. The buoyance assist tool includes a pressure barrier which may comprise a rupture disk assembly. The rupture disk assembly comprises a rupture disk body and rupture disk membrane received in the outer case, wherein the rupture disk body is mounted in the groove. A sleeve is movable from first position in the outer case after the rupture disk ruptures. In the first position the sleeve may extend into the outer case and in the second position the sleeve will completely cover the rupture disk body and will provide for unobstructed full bore flow through the outer case. The outer case is connected to casing joints thereabove and therebelow and comprises a part of a well casing.

In one embodiment the sleeve will trap at least a portion of the rupture disk membrane against an inner surface of the outer case when the sleeve is in the second position. The sleeve may completely cover the rupture disk membrane when it is in the second position and trap the entire rupture disk membrane against an inner surface of the outer case in the second position after the rupture disk ruptures. In another embodiment a well casing comprises the buoyancy assist tool with a float device connected therein. The buoyancy assist tool and the float device define the upper and lower ends of a buoyancy chamber. The sleeve will move from a first to a second position in one embodiment when a predetermined pressure is reached in the well casing above the sleeve. Likewise, in one embodiment the rupture disk membrane will rupture upon application of a predetermined pressure in the well casing above the rupture disk. In one embodiment the rupture disk is a hinged rupture disk.

In another embodiment disclosed herein a well casing comprises a plurality of casing joints with a buoyancy assist tool connected therein. The buoyancy assist tool is connected at its upper and low ends to casing joints. The well casing comprises the plurality of casing joints with the buoyancy assist tool connected therein. A float device connected in the well casing is spaced from the buoyancy assist tool and the buoyancy assist tool and float device define the ends of a buoyancy chamber. The buoyancy assist tool in one embodiment comprises a pressure barrier that is destructible or rupturable and a sleeve movable from first to second positions in the well casing. In the second position the sleeve will cover the pressure barrier after the pressure barrier has been ruptured to provide full bore flow through the casing.

In an embodiment the buoyancy assist tool may comprise an outer case defining upper and lower recesses therein. The sleeve in the buoyancy assist tool has a plurality of latches that will be received in the upper recess in the first position and in a lower recess in the second position. In one embodiment the latches are positioned at the end of the sleeve. In an additional embodiment the latches are spaced from both the upper and lower ends of the sleeve and extend radially outwardly from a generally cylindrical outer surface of the sleeve. The sleeve may comprise a plurality of slits radially spaced around the circumference thereof. The slits are generally longitudinally spaced from and do not reach either of the upper and lower ends of the sleeve. The pressure barrier in one embodiment comprises a rupture disk assembly. The rupture disk assembly may comprise a rupture disk body and a rupture disk membrane connected thereto. The rupture disk assembly may comprise a hinged rupture disk in which a rupture disk membrane is hinged to the rupture disk body or may comprise a rupture disk assembly of a type in which the membrane bursts generally at the center thereof.

DETAILED DESCRIPTION

In the following description, directional terms such as above, below, upper, lower, uphole, downhole, etc., are used for convenience in referring to the accompanying drawings. One who is skilled in the art will recognize that such directional language refers to locations in the well, either closer or farther from the wellhead and that various embodiments of the inventions described and disclosed herein may be utilized in various orientations such as inclined, deviated, horizontal and vertical.

Referring to the drawings, a well 10 comprises a well bore 12 with a well casing 15 therein. Well bore 12 has a vertical portion 16 and a highly deviated or horizontal portion 18. Well casing 15 comprises a plurality of casing joints 17, as reflected by the dashed lines in FIGS. 2-6. Casing joints 17 may have an inner diameter 19. Well casing 15 defines a buoyancy chamber 20. Buoyancy chamber 20 has upper end 22 and lower end 24. Buoyancy chamber 20 will be filled with a buoyant fluid which may be a gas such as nitrogen, carbon dioxide, or air, but other gases may also be suitable. The buoyant fluid may also be a liquid such as water or diesel fuel or other light liquid. The important aspect is that the buoyant fluid have a lower specific gravity than the well fluid in the well bore 12 in which the well casing 15 is run. The choice of gas or liquid, and which one of these are used, is a factor of the well conditions and the amount of buoyancy desired.

A float device 25 such as a float shoe, float collar or other known float device defines the lower end or lower boundary 24 of buoyancy chamber 20. A rupture disk tool 30 which may be referred to as a buoyancy assist tool defines the upper end or upper boundary 22 of buoyancy chamber 20.

Buoyancy assist tool 30 comprises an outer case 32 with upper and lower ends 31 and 33. A pressure barrier, which may comprise a rupture disk assembly 44, is positioned in outer case 32. Outer case 32 comprises an upper case portion 34 connected to a lower case portion 36. Upper and lower case portions 34 and 36 of buoyancy assist tool 30 are connected to casing joints 17 at the upper and lower ends 31 and 33, respectively. Outer case 32 defines an inner surface 38 which defines a passage 40 therethrough. Outer case 32 has a minimum inner diameter 39. A groove 42 is defined in inner surface 38 and may be for example defined by and between upper and lower case portions 34 and 36 of outer case 32. Rupture disk assembly 44 comprises a rupture disk body 46 with a rupture disk membrane 48 connected thereto. Rupture disk assembly 44 is a pressure barrier that will hold pressure sufficient to keep buoyancy chamber 20 closed at the upper end 22 thereof until such time as it is desired to uncap or open upper end 22.

Buoyancy assist tool 30 is used in methods of installing and floating casing 15 in well 12. Running a casing in deviated wells and long horizontal wells often results in significantly increased drag forces and may cause a casing string to become stuck before reaching a desired location. For example, when the weight of the casing produces more drag forces than the available weight to slide the casing down the well, the casing may become stuck. If too much force is applied to the casing string damage may occur. Buoyancy assist tool 30 described herein helps to alleviate some of these issues and at the same time provides for a full bore passageway so that other tools or objects such as for example production packers, perforating guns and service tools may pass therethrough without obstruction after the well casing 15 has reached the desired depth.

Buoyancy assist tool 30 includes a sleeve 52 which may be a sliding sleeve 52. Sleeve 52 defines a bore 54 therethrough with an inner diameter 55. Sleeve 52 may comprise a collet sleeve 52 with collet heads 56 at the end of collet fingers 58. Collet heads 56 define an inner diameter 57 and may define a plug seat 60 for receiving a plug or ball displaced into well casing 15. Sleeve 52 is movable from a first position 62 in well casing 15 to a second position 64. Inner diameter 57 in the second position may be equal to, or greater than minimum inner diameter 39 of outer case 32. Outer case 32 has an upper recess 68 in inner surface 38 and a lower recess 70. In first position 62 collet heads 56 are received in upper recess 68 and in second position 64 collet heads 56 are received in lower or second recess 70. In one embodiment sleeve 52 may have a lower end that extends into rupture disk body 46 in first position 32.

Figure 2:
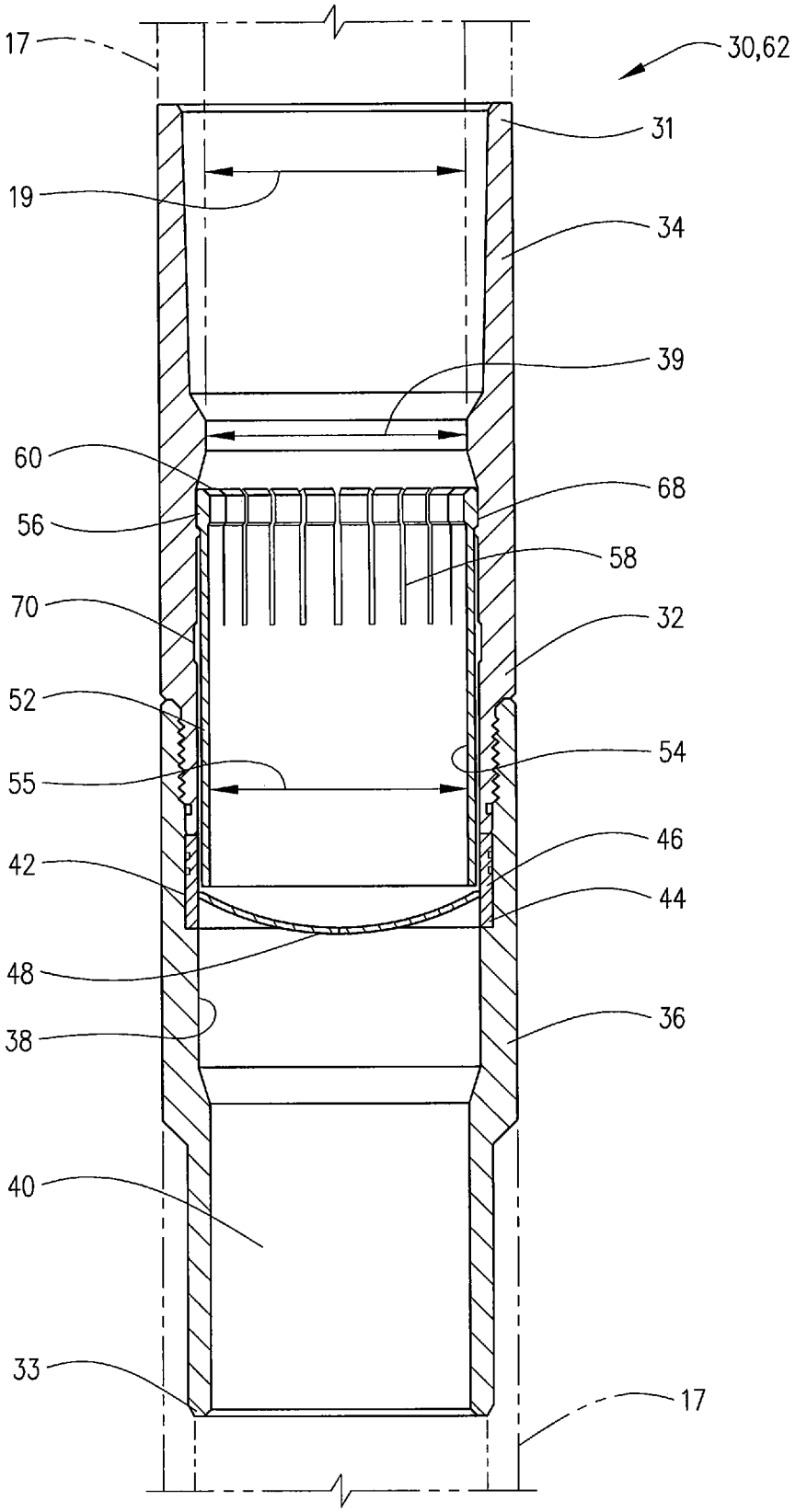
FIG. 2 is a cross section of a buoyancy assist tool.
Figure 3:
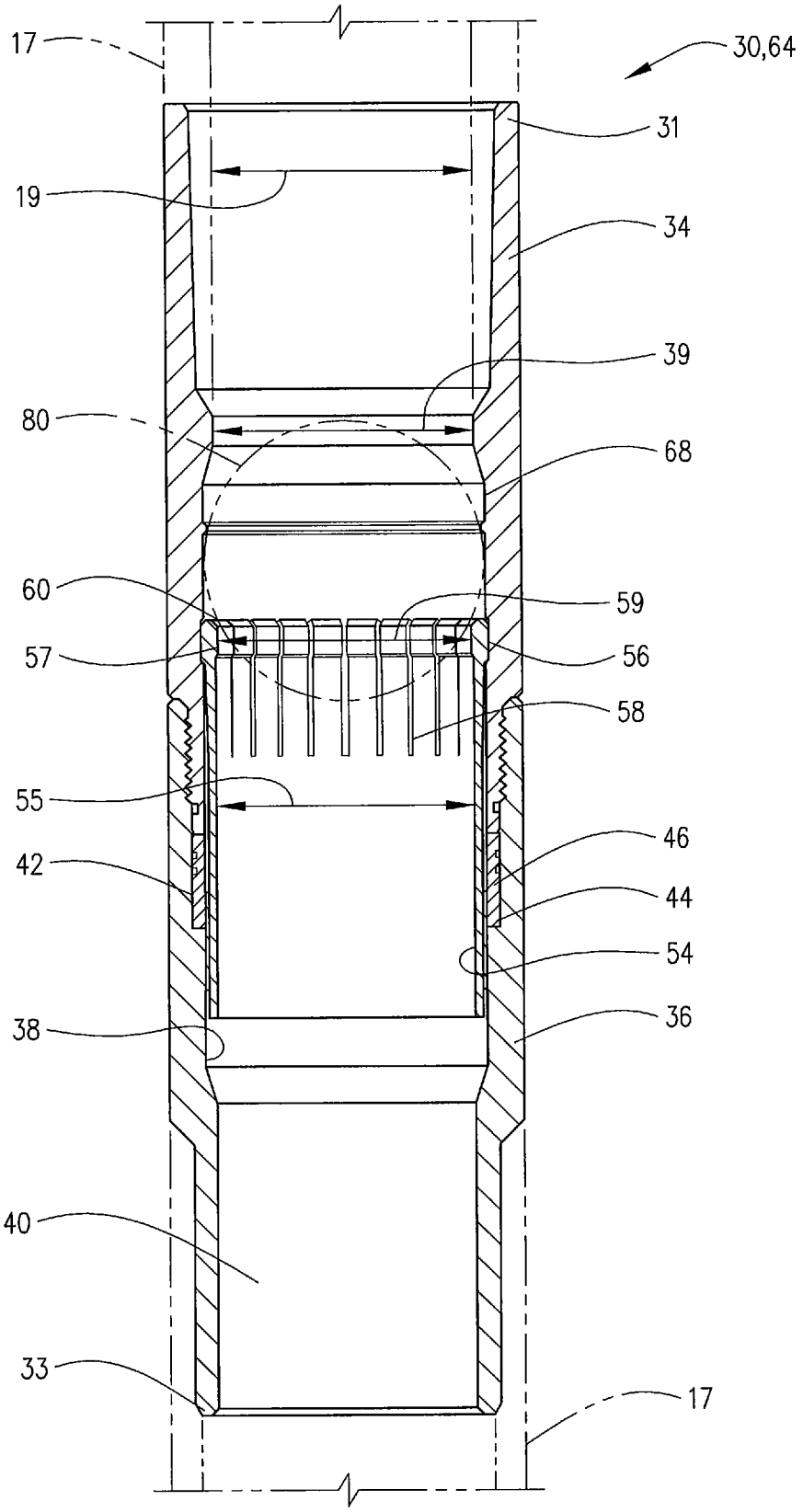
FIG. 3 is a cross section of the buoyancy assist tool moved to a second position.

In operation well casing 15 will be lowered into well bore 12. Buoyancy chamber 20 will aid in the proper placement of casing 15 in that it will reduce friction as well casing 15 is lowered into horizontal portion 18 until a desired final depth is reached. Once the final depth is reached pressure in well casing 15 can be increased to a pre-determined pressure at which the rupture disk membrane 48 of buoyancy assist tool 30 will burst. In the embodiment of FIG. 2, rupture disk membrane 48 is of a type that will burst generally in the center thereof so that of membrane 48 after rupture will still be connected to rupture disk body 46 around a periphery thereof.

After rupture disk membrane 44 has burst or ruptured the fluid in buoyancy chamber 20 will be released, and sleeve 52 may be moved to the second position 64. In second position 64 sleeve 52 will completely cover the rupture disk membrane 48 such that there is no obstruction or blockage to tools or equipment to be passed through well casing 15. Sleeve 52 will capture the ruptured membrane 48 such that it is trapped between sleeve 52 and inner surface 38 of the outer case 32. Because the ruptured membrane 48 is completely trapped and provides no obstruction, full bore flow through well casing 15 is provided. As is apparent from the drawings the inner diameter 39 of bore 40 and/or inner diameter 57 of sleeve 52, whichever is smaller may be substantially the same as the diameter 19 of one of casing joints 17 such that the buoyancy assist tool 30 in the second position 64 provides a full bore passageway. In some instances, the inner diameter 57 of sleeve 52 may be slightly smaller than inner diameter 19 of casing joints 17 but nonetheless will not provide any obstruction and will be large enough such that other devices such as service tools, perforating guns, and production packers may be passed therethrough. It will be understood that the list of tools and equipment provided herein is exemplary and is in no way limiting.

Sleeve 52 may be moved from the first position 62 to the second position 64 in a number of ways. For example, a plug or ball 80 may be delivered into well casing 15 so that it will seat on and engage seat 60 on sleeve 52. Once ball 80 is seated, the hydraulic pressure in well casing 15 can be increased to a predetermined pressure at which sleeve 52 will move from the first position 62 to the second position 64. Collet heads 56 will be pushed from upper recess 68 and will snap or extend radially outwardly into lower recess 70. Once collet heads 56 extend outwardly into lower recess 70, ball 80 or other type of plug will pass though sleeve 52 leaving a full open bore for passage of well equipment and devices.

There are a number of other ways in which sleeve 52 may be configured to move from the first to the second positions. For example, sleeve 52 may be constructed with a differential area such that hydraulic pressure in well casing 52 may move sleeve 52 without the need for a ball or plug. The sleeve 52 may also be moved electromechanically with a solenoid valve or can be manipulated by radio frequency (RF) tag initiation.

Figure 4:
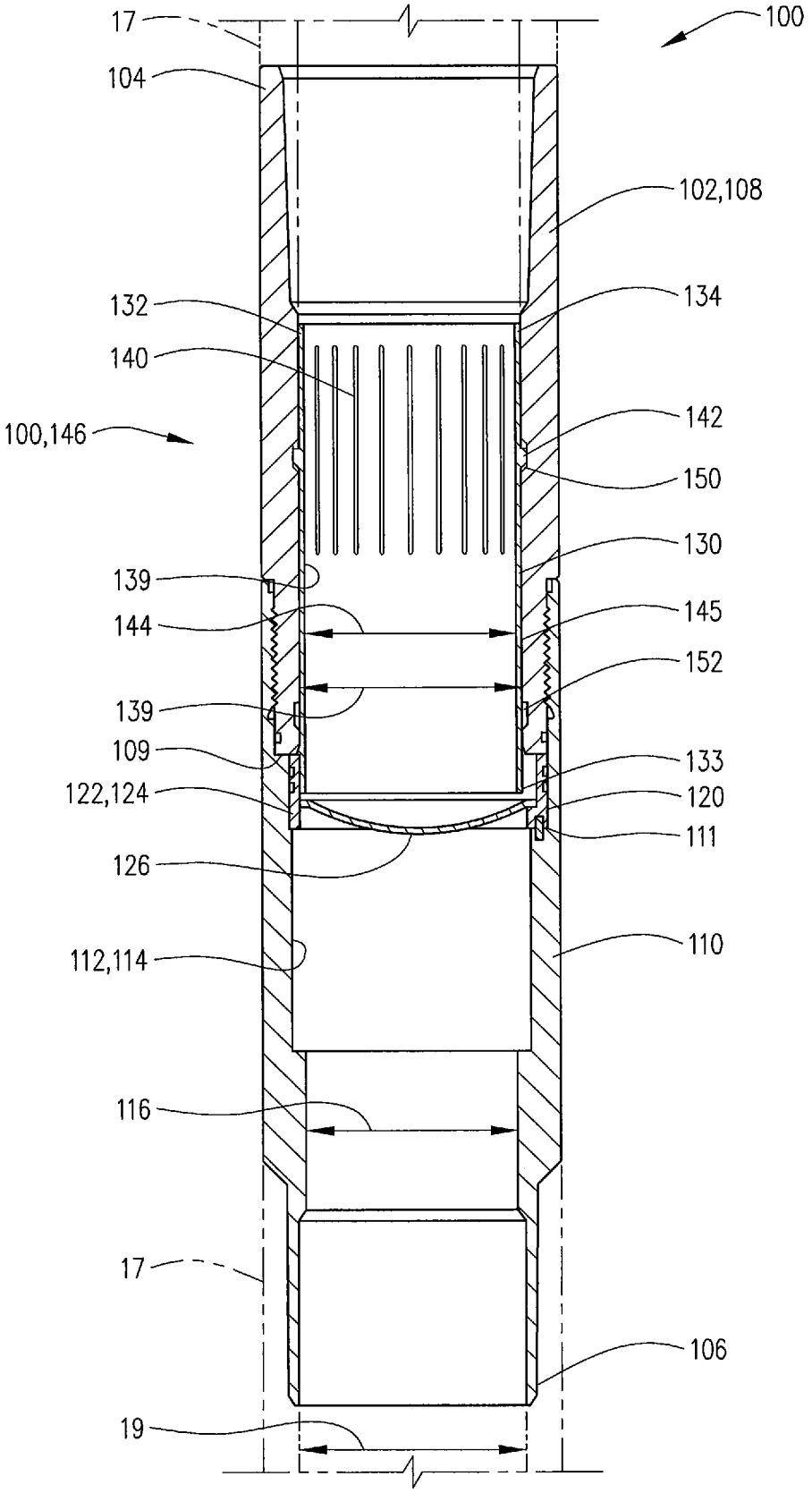
FIG. 4 is an alternative embodiment of a buoyancy assist tool in the second position.
Figure 5:
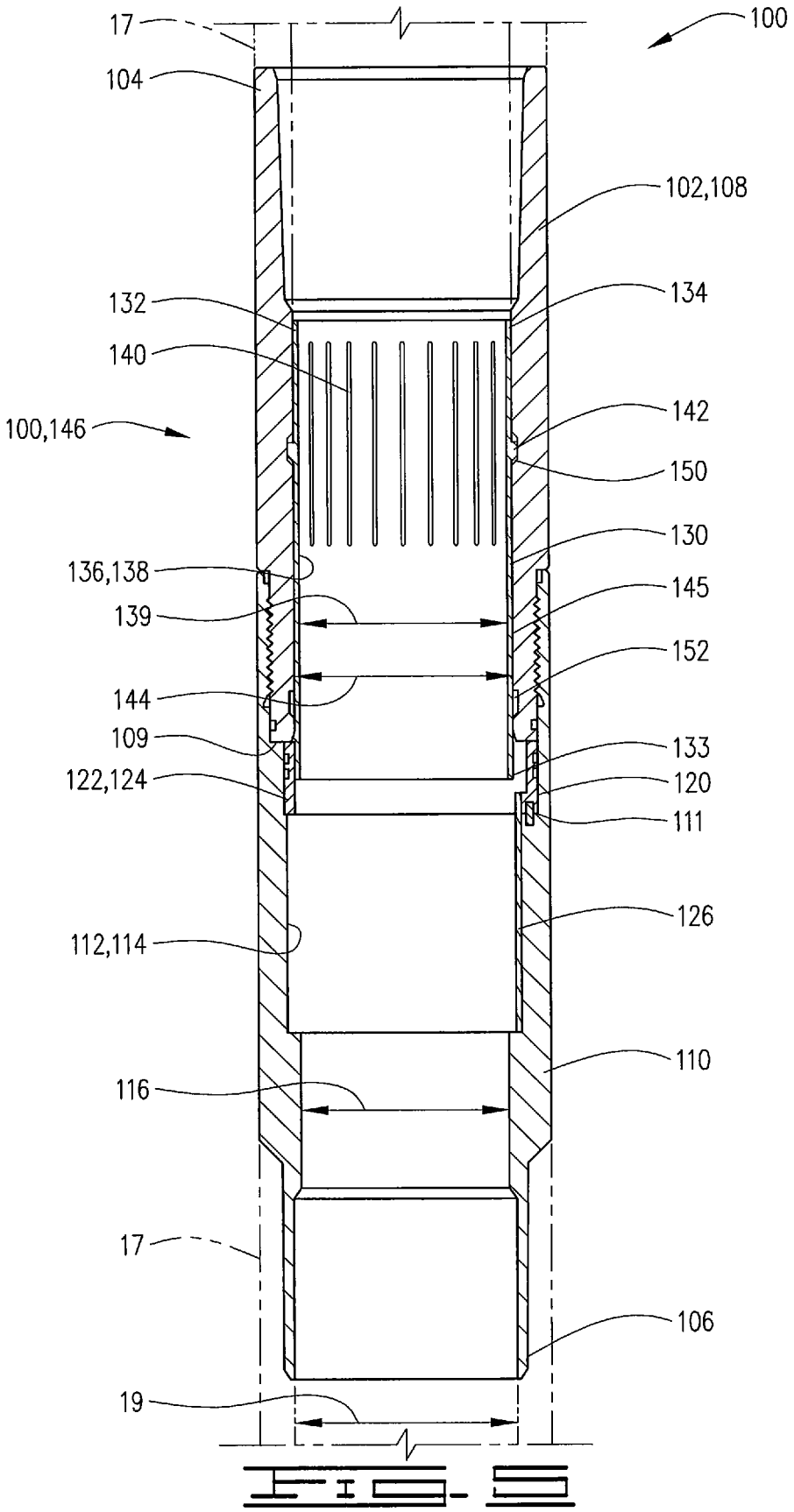
FIG. 5 is the embodiment of FIG. 4 after the rupture disc has ruptured.
Figure 5:
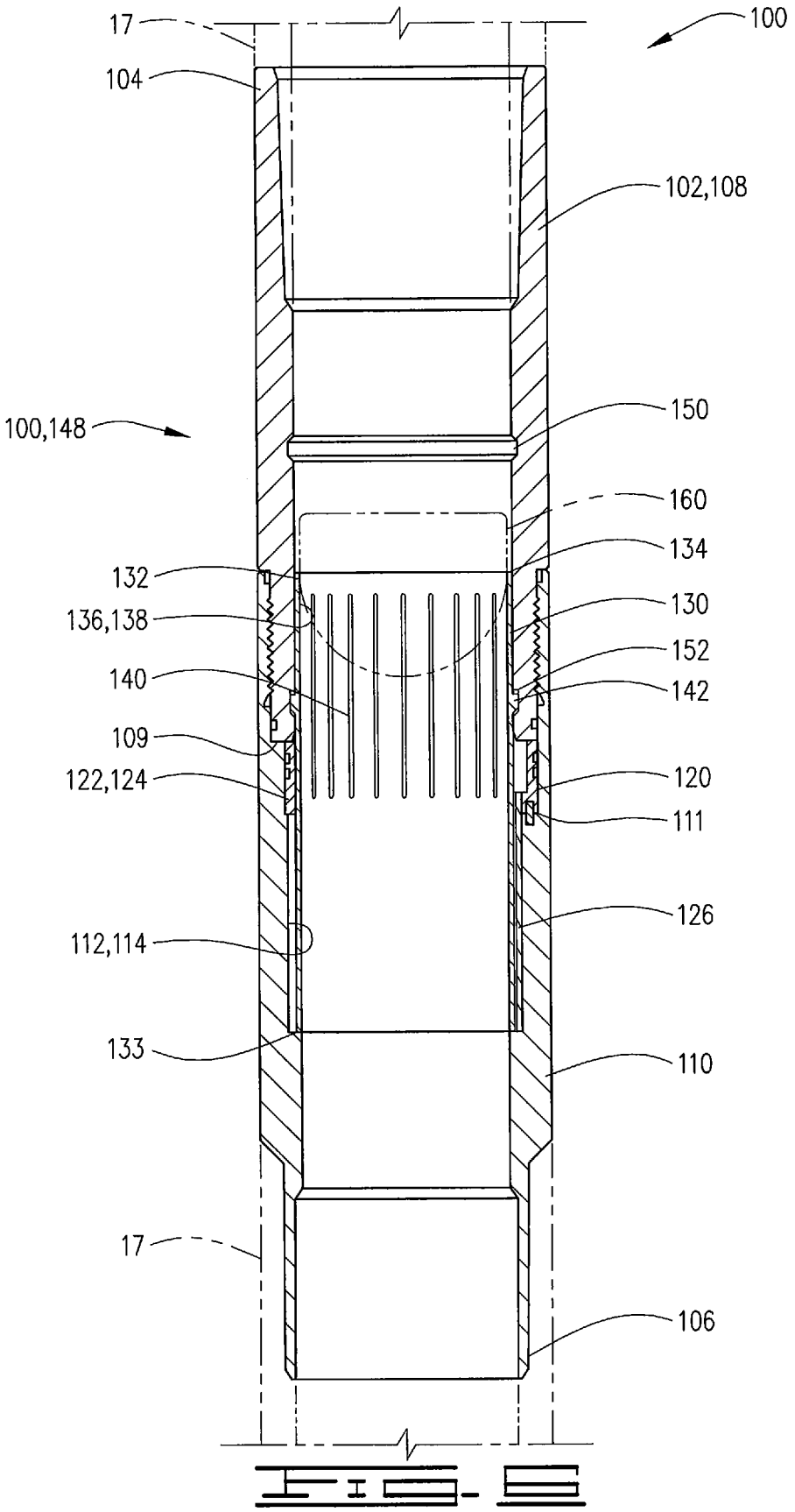

FIGS. 4, 5 and 6 show an additional embodiment of a buoyancy assist tool 100. Buoyancy assist tool 100 is similar to buoyancy assist tool 30, but includes a hinged type rupture disk assembly as opposed to the rupture disk assembly disclosed and described with respect to the embodiment of FIGS. 2 and 3. Buoyancy assist tool 100 has outer case 102 with an upper end 104 and lower end 106. Outer case 102 comprises upper case portion 108 and lower case portion 110 both of which may be connected into a casing string and thus have casing joints 17 connected thereto. Upper case portion 108 has lower end 109. Outer case 102 defines an inner surface 112 which defines flow passage 114 therethrough. The minimum inner diameter of outer case 102 may comprise for example a minimum inner diameter 116 which is the most restrictive diameter in outer case 102. Inner diameter 116 is generally about the same as diameter 19 of casing joint 17 and is sized to allow passage of well equipment therethough.

A groove 120 is defined in inner surface 112 and in the embodiment disclosed is defined by and between upper and lower case portions 108 and 110 respectively. Thus, lower end 109 of upper portion 108 and a shoulder 111 on lower portion 110 define the ends or boundaries of groove 120.

A rupture disk assembly 122 comprising a rupture disk body 124 and rupture disk membrane 126 are received and held in outer case 102. Rupture disk body 124 is received in groove 120 and rupture disk membrane 126 is connected to rupture disk body 124. As is depicted in the figures, groove 120 may be an eccentric groove and have a greater depth on a portion of inner surface 112 to provide for the hinged connection of rupture membrane 126 to rupture disk body 124.

A sleeve 130 has upper end 132 and lower end 133. Sleeve 130 comprises an inner surface 136 which defines bore 138 therethrough. Bore 138 defines inner diameter 139 which may be equal to or slightly larger than the minimum inner diameter 116. Sleeve 130 has a plurality of radially spaced apart slits 140 which provides for flexing of sleeve 130. Slits 140 are positioned between ends 132 and 133 and do not reach the ends thereof. A plurality of heads or latches 142 extend radially outwardly from an outer diameter 144 defined on outer surface 145 of sleeve 130. Heads 142 are longitudinally spaced from ends 132 and 133.

Sleeve 130 is movable in outer case 102 from the first position 146 shown in FIG. 4 to the second position 148 shown in FIG. 6. In first position 146 the lower end 133 of sleeve 130 may extend into rupture disk body 124. As described with respect to the embodiment of FIG. 2 buoyancy assist tool 100 will define the upper end or upper boundary of a buoyancy chamber in a well casing. Once the well casing including buoyancy assist tool 100 has been lowered to the desired depth rupture disk membrane 126 can be burst or ruptured by any manner known in the art. For example and as explained with respect with embodiment of FIG. 2 rupture disk membrane 126 may be burst, or ruptured with a hydraulic pressure increase in the well casing. Once a predetermined pressure is reached the rupture disk membrane 126 will rupture and will move generally to the position shown in FIG. 5. The rupture disk membrane 126 is shown as if it has completely moved to the vertical, but it is understood that the membrane 126 may hinge and may angle outwardly into the flow pressure 112 prior to the time rupture disk assembly 122 moves to second position 148.

Once rupture disk membrane 126 is ruptured sleeve 130 may be moved from the first position 146 second position 148. Sleeve 130 may be moved by displacing a ball or into the well casing such that it engages sleeve. Once the ball 160 is engaged with sleeve 130 an increase in hydraulic pressure will move the sleeve 130 from first position 146 to second position 148. Latches 132 will be forced inwardly and will be released from an upper recess 150 in inner surface 112 and will extend outwardly again into a lower recess 152 in outer surface 112 so that sleeve 130 is held in place in second position 148. In second position 148 sleeve 130 completely covers the burst of rupture disk membrane 126. Rupture disk membrane 126 is captured between sleeve 130 and the inner surface 112 of outer case 102. In this way full bore flow through the well casing is re-established and well devices and equipment as explained above may be passed through buoyancy assist tool 100 and thus into and through the well casing. The embodiment of FIG. 4 like the embodiment of FIG. 2 may include features such that the movement of the sleeve 130 is triggered electromechanically, by hydraulic pressure or RF actuation. In addition the rupture disk can be ruptured by any number of methods including those described above with respect to the embodiment of FIG. 2.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A well casing with a buoyancy chamber comprising:
a plurality of casing joints;
a float device connected in the well casing defining a lower end of the buoyancy chamber;
a rupture disk in the casing defining an upper end of the buoyancy chamber; and
a sliding sleeve disposed in the well casing and movable from first to second positions in the well casing, wherein in the second position the sleeve traps a burst rupture disk membrane against an inner surface of the well casing.

2. The well casing of claim 1, the sliding sleeve comprising a collet sleeve movable from the first to second positions.

3. The well casing of claim 1 wherein the rupture disk membrane is ruptured when a pressure in the casing above the rupture disk reaches a predetermined rupture pressure.

4. The well casing of claim 1, wherein the sleeve moves from the first to the second positions upon hydraulic pressure in the well casing reaching a predetermined pressure required to move the sleeve.

5. The well casing of claim 4, the sleeve defining a seat thereon for receiving a plug delivered into the well casing, wherein hydraulic pressure in the well casing moves the sleeve from the first to the second positions after the plug engages the plug seat.

6. The well casing of claim 5, wherein the plug is released from the sleeve upon the sleeve reaching the second position leaving an unobstructed bore for the passage of well equipment therethrough.

7. A buoyancy assist tool for use in a well casing comprising:
an outer case;
a rupture disk comprising a rupture disk body and a rupture disk membrane disposed in the outer case; and
a sleeve movable from a first position in the outer case to a second position in the outer case after the rupture disk ruptures, wherein in the second position the sleeve completely covers the rupture disk body and rupture disk membrane and provides unobstructed full bore flow through the outer case.

8. The buoyancy assist tool of claim 7, wherein in the second position the sleeve traps the rupture disk membrane against an inner surface of the outer case after the rupture disk has ruptured.

9. The buoyancy assist tool of claim 8 wherein the rupture disk membrane is attached to the rupture disk body after it ruptures.

10. A well casing defining a buoyancy chamber comprising the buoyancy assist tool of claim 7 and a float device connected in the well casing, wherein the buoyancy assist tool and the float device define the upper and lower ends of the buoyancy chamber.

11. The well casing of claim 10, wherein the sleeve moves from the first to the second position when a predetermined pressure is reached in the well casing above the sleeve.

12. The well casing of claim 10 wherein the rupture disk membrane ruptures upon the application of a predetermined hydraulic pressure in the well casing above the rupture disk.

13. The well casing of claim 12, wherein the rupture disk is a hinged membrane rupture disk.

14. A well casing comprising:

a plurality of casing joints;

a buoyancy assist tool having upper and lower ends, the buoyancy assist tool being connected to casing joints at the upper and lower ends thereof and forming a part of the well casing; and a float device connected to the well casing and spaced from the buoyancy assist tool, the buoyancy assist tool and float device defining the ends of a buoyancy chamber, the buoyancy assist tool comprising:

a pressure barrier comprising a rupture disk body and a rupture disk membrane hingedly connected thereto; and a sleeve movable from first to second positions wherein the sleeve covers the rupture disk body and rupture disk membrane in the second position of the sleeve to provide full bore flow through the well casing after the pressure barrier has been opened.

15. The well casing of claim 14, the buoyancy assist tool further comprising an outer case defining upper and lower recesses therein, wherein the sleeve comprises a plurality of latches receivable in the upper recess in the first position and in the lower recess in the second position.

16. The well casing of claim 15, wherein the sleeve is a collet sleeve, and the latches are defined at an upper end of the sleeve.

17. The well casing of claim 15, wherein the latches are spaced from the upper end of the sleeve.

18. The well casing of claim 14, the sleeve defining a plurality of slits radially spaced around the circumference of the sleeve, wherein the slits are longitudinally spaced from and do not reach upper and lower ends of the sleeve.

* * * * *